US006622758B2

(12) United States Patent
Drube et al.

(10) Patent No.: US 6,622,758 B2
(45) Date of Patent: Sep. 23, 2003

(54) INTERLOCK FOR CRYOGENIC LIQUID OFF-LOADING SYSTEMS

(75) Inventors: Thomas K. Drube, Lakeville, MN (US); Claus Emmer, Prior Lake, MN (US)

(73) Assignee: Chart Inc., Burnsville, MN (US)

( * ) Notice: Subject to any disclaimer, the term of this patent is extended or adjusted under 35 U.S.C. 154(b) by 0 days.

(21) Appl. No.: 10/072,624

(22) Filed: Feb. 7, 2002

(65) Prior Publication Data

US 2002/0104581 A1 Aug. 8, 2002

Related U.S. Application Data

(60) Provisional application No. 60/267,517, filed on Feb. 8, 2001.

(51) Int. Cl.[7] ..... B65B 1/04

(52) U.S. Cl. ..... 141/82; 141/95; 141/192; 251/149.9

(58) Field of Search ..... 141/82, 83, 94, 141/95, 192, 197; 137/637.1, 637, 351, 488; 251/149.9

(56) References Cited

U.S. PATENT DOCUMENTS 4,230,161 A * 10/1980 Billington et al. ..... 141/302
4,793,386 A * 12/1988 Sloan ..... 141/65
4,805,672 A * 2/1989 Berrettini et al. ..... 141/5
6,439,278 B1 * 8/2002 Krasnov ..... 141/197

* cited by examiner

*Primary Examiner*—Steven O. Douglas
(74) *Attorney, Agent, or Firm*—Piper Rudnick

(57) ABSTRACT

A cryogenic system that off-loads cryogenic liquid from a delivery vehicle and pumps the cryogenic liquid to a storage tank includes an interlock that enables the pneumatic valves which control the flow of the cryogen. The interlock includes a pneumatic relay, a pneumatic line and a pressure sensing line. The pneumatic line transfers pressurized air to the pneumatic relay while the pressure sensing line pressurizes the pneumatic relay when hoses from a delivery truck are connected to the system. The pneumatic relay includes a housing that defines a chamber with a piston having an arcuate passage located therein. When a hose from the delivery truck is connected to the system, the pressure sensing line detects a change in pressure and pressurizes the pneumatic relay. The pressure displaces the piston of the pneumatic relay which aligns the arcuate passage of the relay with the pneumatic valve to allow pressurized air to travel to the pneumatic valve thereby opening the pneumatic valve.

16 Claims, 5 Drawing Sheets

INTERLOCK FOR CRYOGENIC LIQUID OFF-LOADING SYSTEMS

CLAIM OF PRIORITY

This application claims priority from U.S. Provisional Patent Application Serial No. 60/267,517, filed Feb. 8, 2001.

FIELD OF THE INVENTION

The present invention relates generally to systems for refilling the storage tanks of cryogenic liquid dispensing stations and, more particularly, to an interlock that prevents spills during off-loading of cryogenic liquid from a delivery vehicle to a cryogenic liquid dispensing station.

BACKGROUND OF THE INVENTION

Liquid natural gas (LNG) is a cryogenic liquid that is plentiful, environmentally friendly and domestically available energy source and, therefore, is an attractive alternative to oil. As a result, LNG is increasingly being used as a fuel for vehicles. This is especially true for fleet and heavy duty vehicles.

Due to the increased use of LNG, dispensing stations for refueling LNG-powered vehicles are becoming more common. LNG dispensing stations typically include at least an insulated tank containing a supply of LNG and a pump that dispenses the LNG to the vehicle or saturation/conditioning components.

The dispensing station is periodically refilled by a delivery vehicle such as a tank truck. The delivery truck features a tank containing a supply of LNG as well as a liquid feed hose in communication with the liquid side thereof and a vapor return hose in communication with the vapor side thereof. LNG is off-loaded from the delivery truck tank by connecting the feed hose to a pump that is on-site and in communication with the dispensing station tank. The vapor return hose is placed in communication with the line between the pump and the dispensing station tank. Vapor from the head space of the dispensing station tank is returned via the vapor return hose to the vapor side of the delivery truck tank to relieve pressure build-up in the dispensing station tank. LNG is transferred from the delivery truck tank to the dispensing station tank when the pump is activated.

It has become common practice in the industry to use the same pump to dispense and or condition the LNG and to off-load the LNG from the delivery truck. For example, the pump dispenses LNG from the tank for use. The pump also off-loads LNG from a transport truck to refill the tank. In such stations, automatic and pneumatically operated valves typically control the piping status so that the station may be configured in either the dispense mode or the delivery truck off-load mode. If by some error or failure the valves are improperly set, however, an upset condition may occur. For example, the station could be configured to off-load LNG when the delivery truck hoses are not connected to the station. In addition, even if the station valves were functioning properly, a delivery truck driver could drive away from the station with the delivery truck hoses still connected (known as a "drive off") and the station still configured for off-loading LNG. In both situations, spillage of LNG could occur. Such an occurrence is undesirable from the standpoint that LNG is wasted and a hazardous condition for the delivery truck driver and environment could be created.

Alternatively, a pump separate from the station dispensing pump may be used to off-load LNG from the delivery truck. With such an arrangement, the liquid feed and vapor return hoses of the delivery truck are also connected to the off-loading pump inlet and outlet sides, respectively. The valves in such a station are typically configured manually by the delivery truck driver. If the delivery truck driver incorrectly configures the valves, or if the delivery truck driver drives off without disconnecting the liquid feed and vapor return hoses, spillage of LNG may also occur.

Prior art dispensing stations attempt to solve the above problems by providing a check valve in the station line running between the off-loading pump and the connection for the delivery truck liquid feed hose. As a result, one way flow of LNG from the delivery truck through the pump and to the station tank is ensured. A disadvantage of this approach, however, is that a pressure drop occurs across the check valve so that pump prime is adversely effected. Furthermore, a check valve may not be installed in the station line running between the station tank and the connection for the delivery truck vapor return line. As a result, this line may be a source of LNG spills even if a check valve is installed in the station liquid fill line.

SUMMARY OF THE INVENTION

The present invention is directed to an apparatus for interlocking a cryogenic fluid dispensing station with a cryogenic fluid delivery vehicle. The dispensing station includes an off-loading port that is connected to a tank mounted on a fluid delivery vehicle. The off-loading port receives cryogenic fluid from the delivery vehicle. A pressure sensor is coupled to the off-loading port to sense the cryogenic fluid pressure at the port. A dispensing station valve is in fluid communication with the off-loading port. The dispensing station valve operates between an open position and a closed position wherein the dispensing station valve closes when the pressure sensor senses a fluid pressure at the port below a predetermined level.

Another aspect of the invention is directed to a method of interlocking a cryogenic fluid dispensing station. The method of interlocking the cryogenic fluid dispensing station includes connecting a tank mounted on a fluid delivery vehicle to an off-loading port of the dispensing station. Cryogenic fluid is delivered from the fluid delivery vehicle to the dispensing station through the off-loading port. The off-loading port senses the fluid pressure of the cryogenic fluid. When the fluid pressure of the cryogenic fluid is below a predetermined level, a valve in communication with the off-loading port is closed.

The following detailed description of embodiments of the invention, taken in conjunction with the accompanying drawings, wherein like characters identify identical parts, provide a more complete understanding of the nature and scope of the invention.

DETAILED DESCRIPTION

Figure 1:
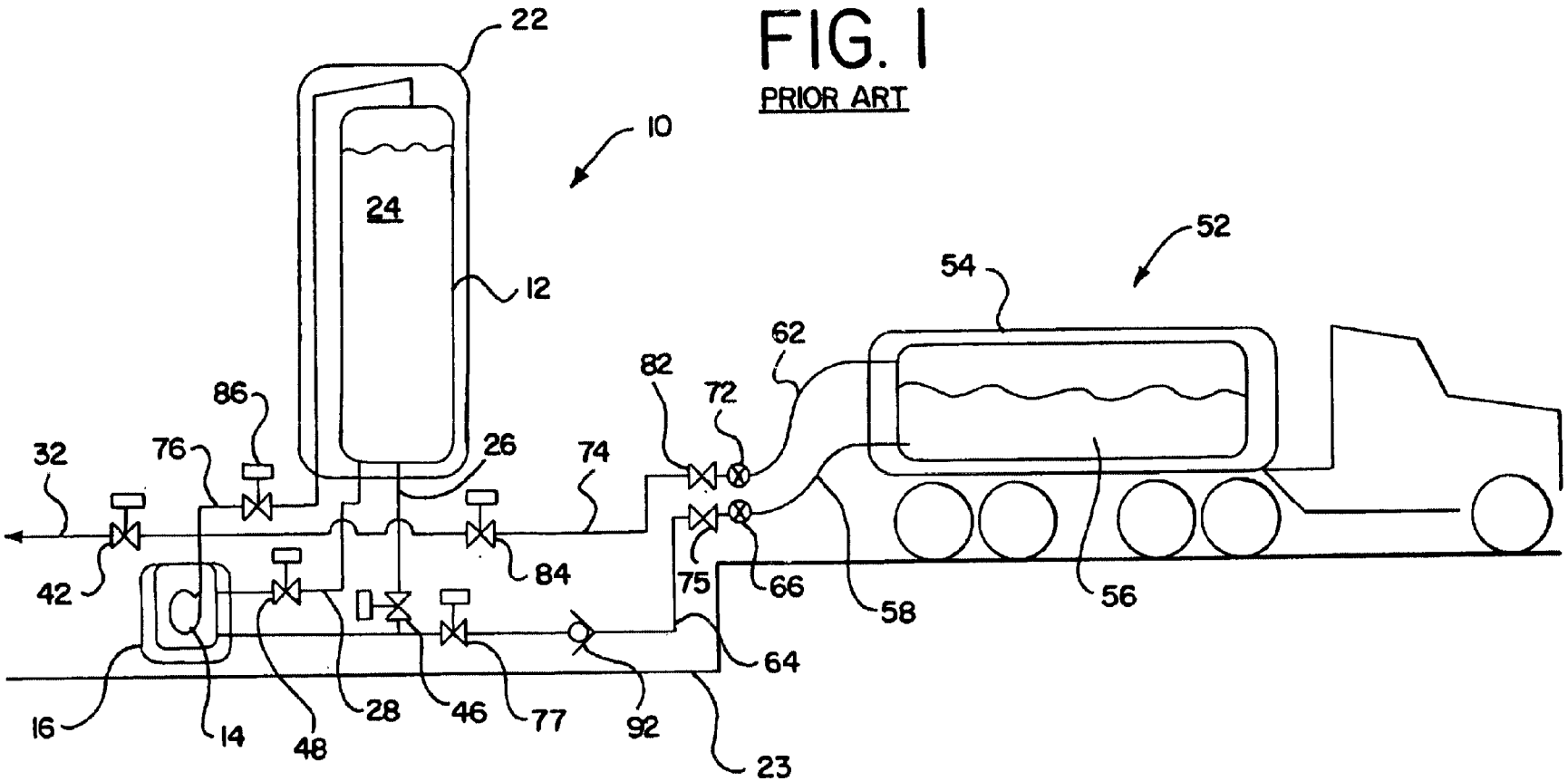
FIG. 1 PRIOR ART
FIG. 1 is a schematic diagram of a prior art dispensing station to which a delivery truck is connected for off-loading LNG.

A portion of a typical prior art dispensing station is indicated in general at 10 in FIG. 1 and includes a storage tank 12 as well as a pump 14 positioned within a jacket-insulated sump 16. Cryogenic liquids, such as liquid natural gas (LNG), have a boiling point below −150° F. at atmospheric pressure. As a result, storage tank 12 of the dispensing station is vacuum insulated via a jacket 22. The storage tank 12 contains a supply of LNG 24. The components of the dispensing station illustrated in FIG. 1 are positioned within a containment pit 23. Containment pit 23 prevents leaked LNG from flowing away from the dispensing station.

Sump 16 communicates with tank 12 via fill line 26 and overflow line 28 so that it remains filled with LNG. As a result, pump 14 is submerged in LNG. This prevents cavitation in the pump and allows dispensing to begin without the pump cool down period that would otherwise be required. Pump 14 pumps the LNG in sump 16 through line 32 to the user device. Alternatively, line 32 may lead to a saturation arrangement (not shown) so that the LNG is conditioned prior to dispensing. An example of a LNG dispensing station featuring such a saturation arrangement is presented in U.S. Pat. No. 5,682,750 to Preston et al., which is owned by the assignee of the present application. Lines 26, 28 and 32 feature pneumatically operated valves 46, 48 and 42, respectively. Alternatively, valves 46, 48 and 42, and the others described herein, could be operated with hydraulics or electrical relays. During the dispensing or saturation of LNG 24, valves 46, 48 and 42 are open while the remaining valves illustrated in FIG. 1 are closed.

In addition to dispensing, pump 14 is commonly used to refill tank 12 by off-loading LNG from a delivery vehicle such as a tank truck, indicated in general at 52 in FIG. 1. Tank truck 52 features an insulated tank 54 containing a supply of LNG 56, liquid feed hose 58 and vapor return hose 62. During off-loading, as illustrated in FIG. 1, the liquid side of the delivery tank truck 52 is connected via liquid feed hose 58 and hose connector 66 to a line 64, which leads to sump 16. Similarly, the vapor space of the delivery tank truck 52 is connected via vapor return hose 62 and hose connector 72 to line 74, which leads to a line 76. The outlet of pump 14 communicates with the head space of tank 12 via the line 76.

Line 64 features manually operated valve 75 and pneumatically operated valve 77. Line 74 includes manually operated valve 82 and pneumatically operated valve 84. Line 76 includes pneumatically operated valve 86. During off-loading, these valves are all opened. In contrast, valves 42, 46 and 48 are closed. As a result, sump 16 does not receive LNG from tank 12 and the outlet of pump 14 is isolated from the dispensing or saturation portion of the station. Instead, LNG flows from delivery tank truck 52 to sump 16 via hose 58 and line 64 and is pumped by pump 14 through line 76 to dispensing station tank 12. As a result, tank 12 is refilled. Vapor from the head space of station tank 12 returns to the delivery truck tank via line 76, line 74 and hose 62 to relive pressure build-up in the tank 12 prior to activation of pump 14.

As illustrated in FIG. 1, line 64 features a check valve 92 which prevents LNG from flowing back towards the delivery truck. As a result, LNG spills are prevented in the event that valves 75 and 77 are open when the feed hose 58 is not attached to connector 66. Such a situation could occur if there was an error or failure in the valve control system or if the delivery truck driver drove off without disconnecting the feed hose 58. The resulting LNG spill would be worse if any of valves 86, 48 or 46 were also open. Even with check valve 92 present, however, LNG spills could still occur through line 74 if the vapor return hose 62 was not attached to connector 72. This could occur if valves 82, 84 and 86 were open.

Figure 2:
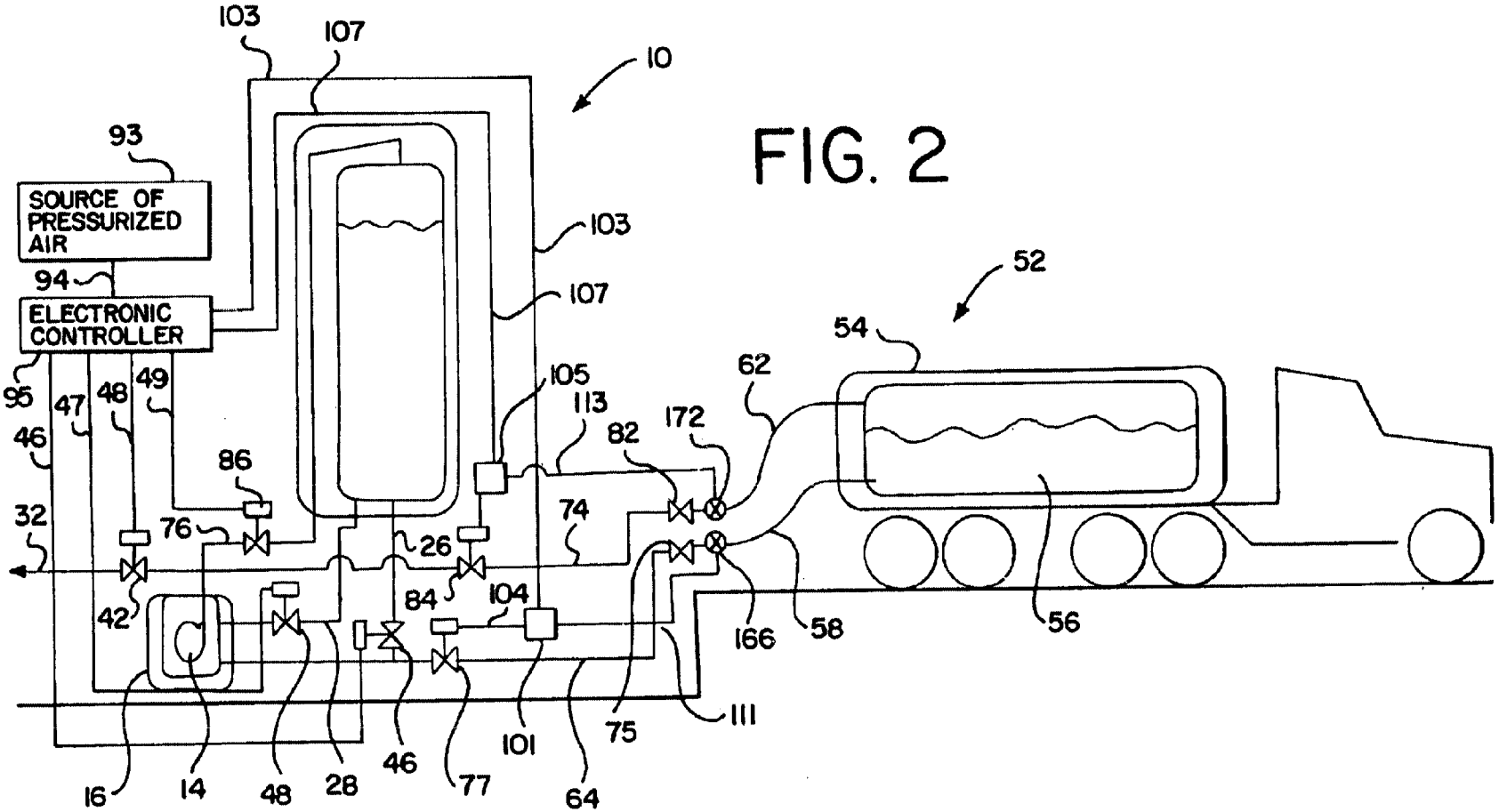
FIG. 2 is a schematic diagram of the dispensing station and delivery truck of FIG. 1 where the dispensing station is equipped with an embodiment of the interlock for cryogenic liquid off-loading system of the present invention.

FIG. 2 illustrates the pneumatic and electronic control system for the valves connected to the dispensing station of FIG. 1. A source 93 of air communicates under the direction of electronic controller 95 with all of the pneumatically operated valves of FIG. 1 except manually controlled valves 75 and 82. Controller 95 is programmed to open the valve 46 via line 96, valve 48 via line 97 and valve 42 via line 98, so that the station tank is configured for the dispensing/saturation mode. Controller 95 is also programmed to close valves 46, 48 and 42 open valve 77 via line 103, valve 84 via line 107 and valve 86 via line 99, so that the station tank is configured for the off-load mode.

An embodiment of the interlock system of the present invention includes a pneumatic relay 101 positioned on the pneumatic line 103 that runs between the electronic controller 95 and pneumatically operated valve 77. This preferred interlock embodiment also includes a pneumatic relay 105 positioned on the pneumatic line 107 that runs between the electronic controller 95 and pneumatically operated valve 84. Pressure sensing line 111 provides communication between pneumatic relay 101 and connector 166, or port, while pressure sensing line 113 provides communication between pneumatic relay 105 and connector 172, or port. Connectors 166 and 172 may be, for example, standard three inch Compressed Gas Association (CGA) connectors for LNG. As will become apparent, the check valve 92 illustrated in FIG. 1 is unnecessary when the interlock of the present invention is installed and, therefore, it has been omitted from FIG. 2.

Figure 3A:
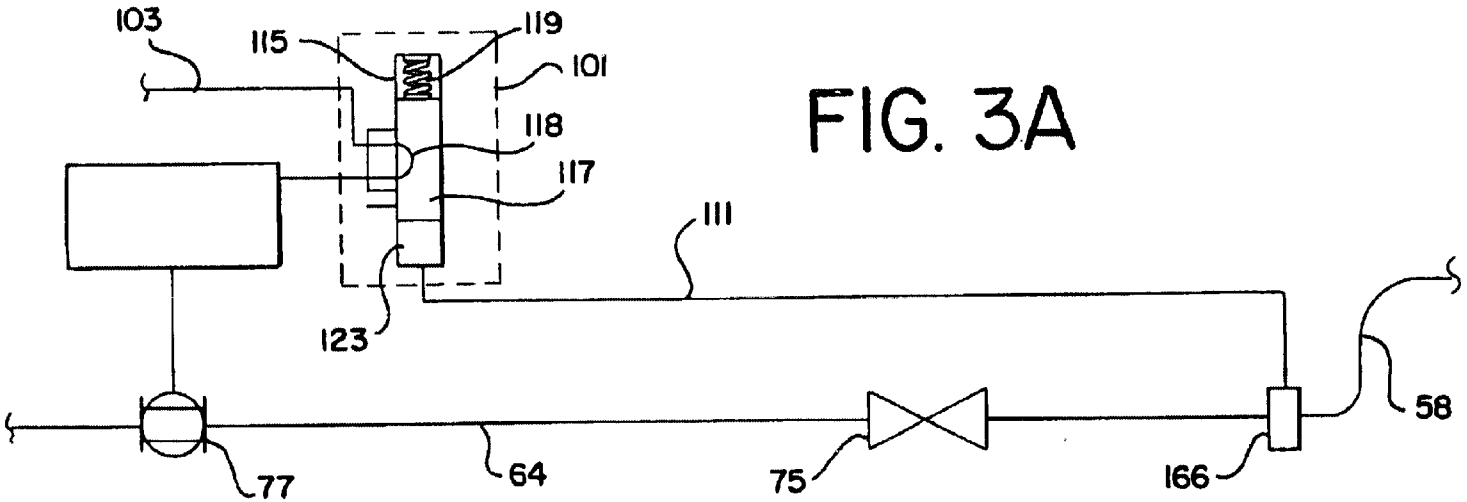
FIG. 3A is a more detailed schematic diagram of the embodiment of the interlock for cryogenic liquid off-loading system of the present invention illustrated in FIG. 2, set in the enabled mode.

As illustrated in FIG. 3A, the pneumatic relay 101 includes a housing 115 within which a sliding piston 117 is positioned. A two ended, preferably arcuate passage 118 is formed in the piston 117. A compression spring 119 or other mechanical biasing means, such as a helical spring or a leaf spring, is disposed in the housing on one side of the piston 117 and biases the cylinder 117 to a lower position. An open chamber 123 exists on the opposite side of the piston 117.

As illustrated in FIG. 3A, when the delivery truck liquid feed hose 58 is attached to connector 166, such as during an off-loading scenario, the chamber 123 of pneumatic relay 101 is pressurized via pressure sensing line 111. As a result, the piston 117 is lifted so that arcuate passage 118 is in alignment with pneumatic line 103. As such, when the interlock is in this enabled mode, valve 77 may be opened under the direction of controller 95 (FIG. 2).

Pressures in the range of 2 psi to 20 psi within pressure sensing line 111 and chamber 123 are typical when feed hose 58 is attached to connector 166. The pneumatic relay 101 may be adjusted to activate the enabled mode when the pressure within the pressure sensing line 111 reaches a predetermined level. As such, the interlock embodiment may be fine tuned depending upon the desired application or sensitivity. For example, if the pneumatic relay 101 was set to activate the enabled mode at too low a pressure, the pressure of LNG exiting line 64 through connector 166 when a drive off occurs could be enough to falsely indicate the presence of the delivery truck feed hose 58 to the pressure sensing line 111 and pneumatic relay 101.

Figure 3B:
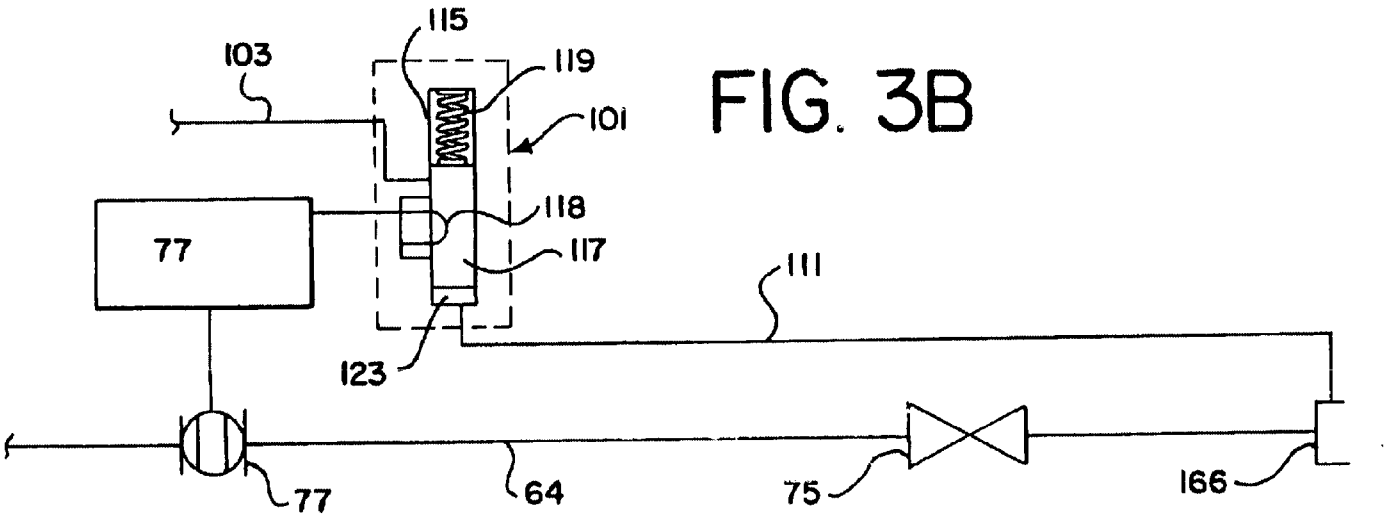
FIG. 3B is a more detailed schematic diagram of the embodiment of the interlock for cryogenic liquid off-loading system of the present invention illustrated in FIG. 2, set in the safe mode.

As illustrated in FIG. 3B, the interlock goes into safe mode when the delivery truck feed hose 58 of FIG. 3A is removed. Under such circumstances, pressure sensing line 111 is at atmospheric pressure and chamber 123 of pneumatic relay 101 is not pressurized. As a result, as illustrated in FIG. 3B, piston 117 is pushed down by compression spring 119 so that arcuate passage 118 is moved out of alignment from pneumatic line 103. Air from pressurized air source 93 (FIG. 2) is therefore unable to reach pneumatically operated valve 77 which closes as its default configuration.

The interlock embodiment therefore automatically closes valve 77 when the delivery truck feed hose 58 is not attached to connector 166 so that LNG does not flow through line 64 and cause a spill regardless of the configuration of valve 75, or any of the other station valves. As such, the interlock protects against LNG spills in the event of drive offs, controller error or failure in the configuration of the station valves.

The pneumatic relay 105 and pressure sensing line 113 of FIG. 2 operate in a similar fashion with regard to pneumatic line 107, pneumatically operated valve 84, connector 172 and vapor return hose 62. When the vapor return hose 62 is attached to the connector 172, the pneumatic relay 105 is pressurized via pressure sensing line 113. As a result, the interlock embodiment is enabled and the pneumatically operated valve is opened. Additionally, spills via line 74 are also avoided in the event of drive offs, controller error or failures when the vapor return hose is not attached to connector 172.

It should be noted that the specific structure of the pneumatic relay 101 illustrated in FIGS. 3A and 3B is presented as an example only. As is known in the art, alternative types of pneumatic relays may be substituted. Suitable pneumatic relays may be obtained from, for example, Airtrol Components, Inc. of New Berlin, Wis. or Clippard Europe S.A. of Belgium.

Alternatively, the valves in the present invention may also be controlled hydraulically by a pressurized liquid. The valves of the present invention could also be controlled electrically by a number of electrical relays.

Figure 4:
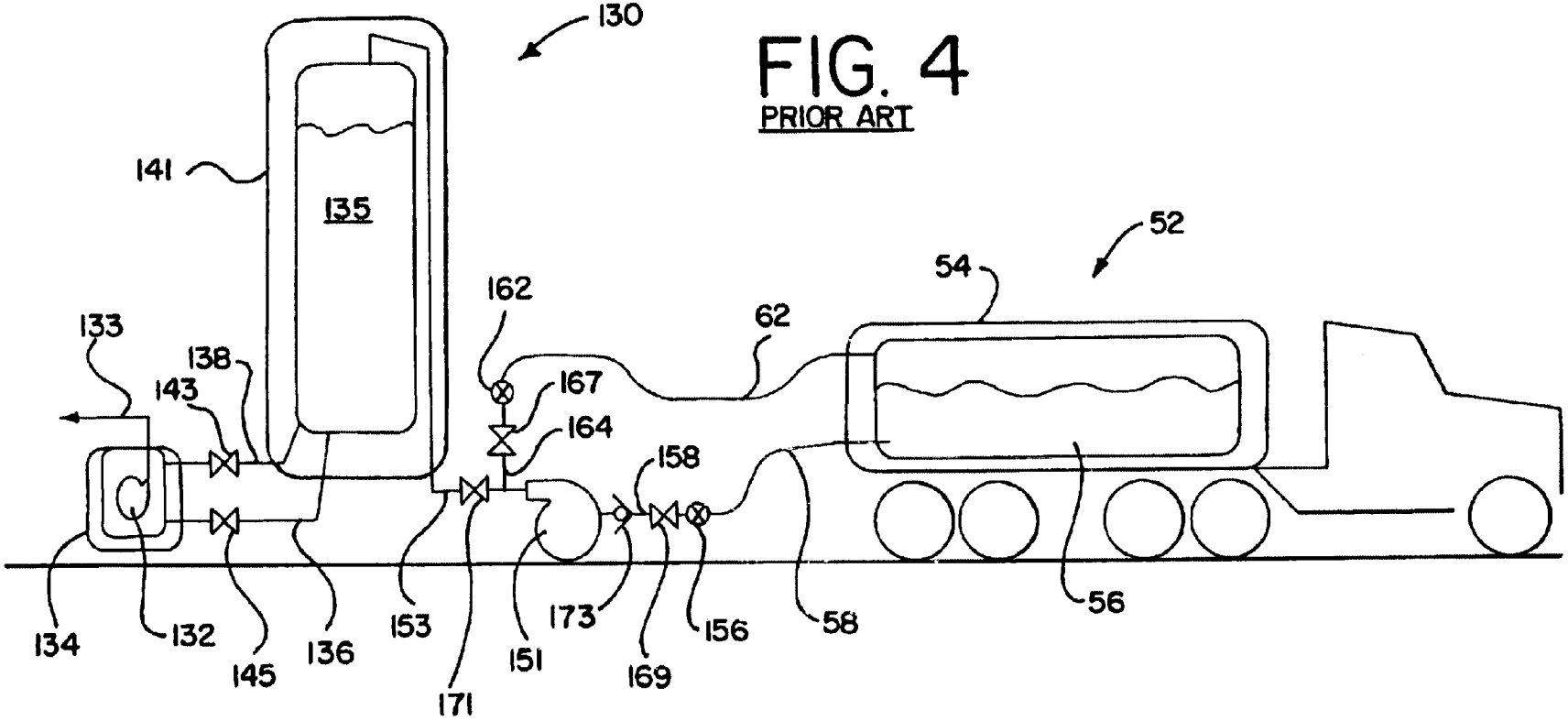
FIG. 4 PRIOR ART
FIG. 4 is a schematic diagram of a second prior art dispensing station to which a delivery truck is connected for off-loading LNG.

FIG. 4 illustrates in general at 130 a portion of a dispensing station that does not use the same pump for dispensing and off-loading. Such an arrangement allows dispensing or saturation to occur simultaneously with off-loading from a delivery truck 52 so that interruptions in station operation are prevented.

Similar to the dispensing station illustrated in FIGS. 1 and 2, a pump 132 for dispensing or transferring LNG to a dispensing, saturation or conditioning arrangement via line 133 is positioned within a jacket-insulated sump 134. Sump 134 receives LNG via fill line 136 and overflow line 138 from a storage tank 135. Storage tank 135 is vacuum insulated via a jacket 141. Valves 143 and 145 are used to isolate the sump 134 from the storage tank 135 so that the sump 134 may be drained for maintenance operations on the pump 132.

A dedicated off-loading pump 151 communicates with the head space of storage tank 135 via line 153 and a connector 156 via line 158. A vapor return hose 62 attaches to the station via connector 162 and communicates with line 153 via line 164. During off-loading of LNG 56 from tank 54 of delivery truck 52, manually operated valves 167, 169 and 171 are opened. Check valve 173 prevents LNG from flowing through line 158 and spilling in the event that feed hose 58 is not present.

Figure 5:
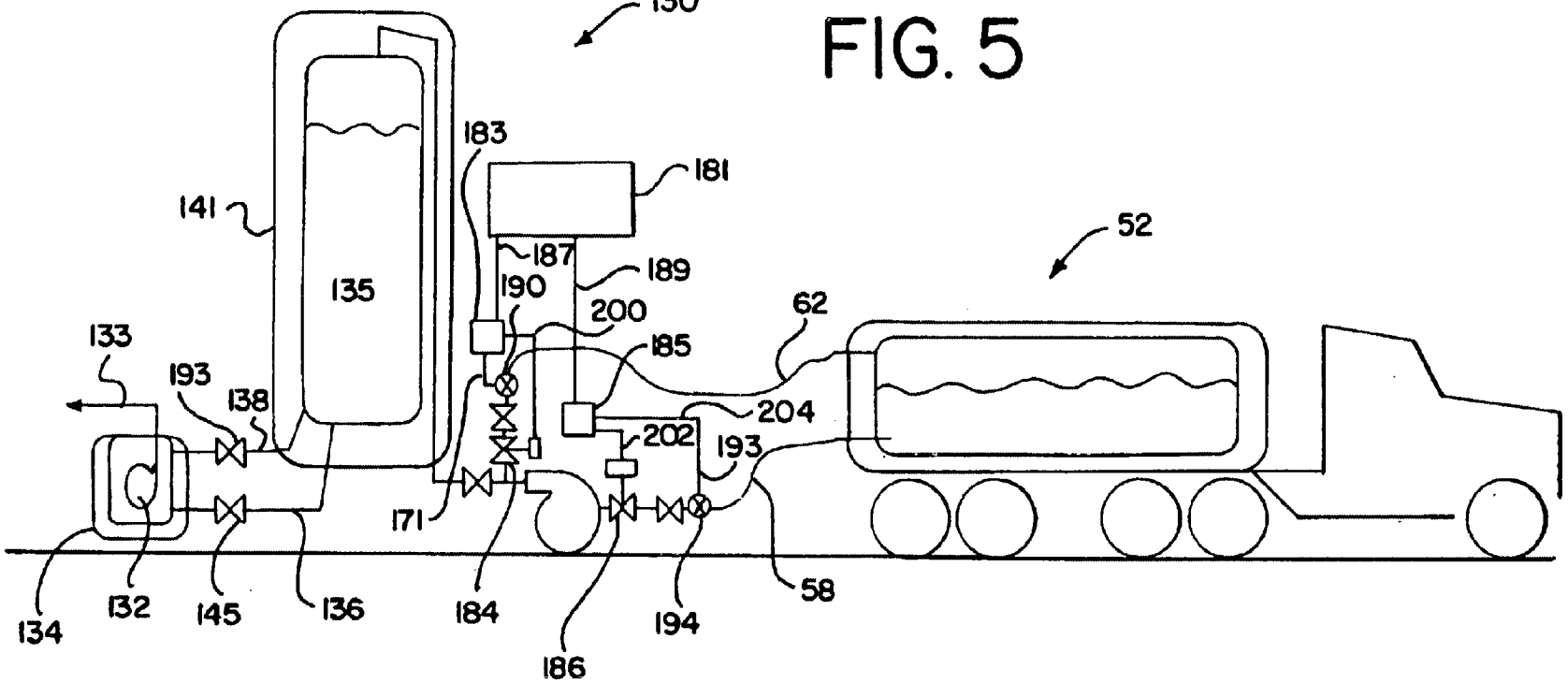
FIG. 5 is a schematic diagram of the dispensing station and delivery truck similar to FIG. 4 but where the dispensing station is equipped with a second embodiment of the interlock for cryogenic liquid off-loading system of the present invention.

While the valves of the station of FIG. 4 are manually operated, the interlock embodiment of the present invention may be provided by adding a source of pressurized air 181, as illustrated in FIG. 5. The source of pressurized air communicates with pneumatically operated valves 184 and 186 via lines 187 and 189, respectively. Valves 184 and 186 are configured to be open when placed in communication with the source of pressurized air 181.

Pneumatic relay 183 is positioned within line 187 while pneumatic relay 185 is positioned within line 189. Pneumatic relays 183 and 185 may feature the same construction as pneumatic relay 101 illustrated in FIGS. 3A and 3B. Pneumatic relay 183 communicates with connector 190 via pressure sensing line 191 while pneumatic relay 185 communicates with connector 194 via pressure sensing line 193.

The embodiment of the interlock of the present invention illustrated in FIG. 5 operates in a manner similar to the embodiments illustrated in FIGS. 2, 3A and 3B. That is, when the delivery truck feed hose 58 is attached to connector 156, pressure sensing line 193 pressurizes pneumatic relay 185 of the interlock so that the pneumatic relay 185 is set to an enabled mode. Pressurized air source 181 is therefore permitted to communicate with valve 186 via line 202. As a result, pneumatically operated valve 186 is opened. Similarly, when vapor return hose 62 is attached to connector 162, the pneumatic relay 183 of the interlock is pressurized via pressure sensing line 191 so that air is permitted to travel from pressurized air source 181 to pneumatically operated valve 184. As a result, valve 184 is opened.

If either the feed hose or vapor return hose of FIG. 5 is disconnected from the station, the appropriate pressure sensing line and pneumatic relay are exposed to atmospheric pressure thereby closing the associated pneumatic valve. This prevents a LNG spill regardless of the setting of the remaining station valves.

In an alternative embodiment, one interlock would be in communication with the both the valve controlling the feed hose and the valve controlling the vapor return hose. The interlock would open the valves once the pneumatic relay of the interlock is pressurized via the corresponding pressure sensing line.

It is to be understood that while the present invention is described above in terms of liquid natural gas (LNG) dispensing stations, dispensing systems for alternative types of fuels and/or cryogenic liquids represent additional applications for the invention. Furthermore, while illustrated above, the present invention may also be used with dispensing systems that do not feature a pump in a sump.

While the preferred embodiments of the invention have been shown and described, it will be apparent to those skilled in the art that changes and modifications may be made therein without departing from the spirit of the invention.

What is claimed is:

1. Apparatus for interlocking a cryogenic fluid dispensing station with a cryogenic fluid delivery vehicle, comprising:

an off-loading port of the dispensing station adaptable to be connected to a tank mounted on a fluid delivery vehicle so as to receive cryogenic fluid therefrom;

a pressure sensor coupled to the off-loading port for sensing cryogenic fluid pressure at the port; and a dispensing station valve in fluid communication with the off-loading port an operable between an open position and a closed position, the dispensing station valve closing responsive to the pressure sensor sensing a fluid pressure at the port below a predetermined level wherein the fluid from the tank mounted on the delivery vehicle flows to the dispensing station when the dispensing valve is open.

2. The apparatus of claim 1, wherein the dispensing station valve is in communication with a cryogenic fluid pump.

3. The apparatus of claim 1, wherein the pressure sensor includes a pneumatic sense line.

4. The apparatus of claim 1, wherein the off-loading port is connectable to a delivery vehicle supply hose.

5. The apparatus of claim 1, wherein the off-loading port is connectable to a delivery vehicle vapor return hose.

6. The apparatus of claim 1, further comprising a relay in communication with the pressure sensor, wherein the relay closes the dispensing station valve responsive to the pressure sensor sensing a fluid pressure below the predetermined level.

7. The apparatus of claim 6, wherein the relay is pneumatic and includes a housing that defines a chamber with a piston having a passage located therein.

8. The apparatus of claim 7, wherein the pressure from the pressure sensor displaces the piston of the relay thereby aligning the passage with an air source and the dispensing station valve to allow pressurized air to travel through the passage to open the dispensing station valve.

9. The apparatus of claim 8, wherein the passage is arcuate.

10. The apparatus of claim 7, wherein the relay further comprises a biasing means for maintaining the piston in a disconnected position when the pressure sensor senses a fluid pressure below the predetermined level.

11. A method for interlocking a cryogenic fluid dispensing station with a cryogenic fluid delivery vehicle, comprising the steps of:

connecting a tank mounted on a fluid delivery vehicle to an off-loading port of a dispensing station;

delivering cryogenic fluid from the fluid delivery vehicle to the dispensing station through the off-loading port;

during said step of delivering, sensing a fluid pressure of the cryogenic fluid at the off-loading port; and responsive to sensing that the fluid pressure of the cryogenic fluid has dropped below a predetermined level, closing a valve on a cryogenic fluid conduit in communication with the off-loading port.

12. Apparatus for interlocking a cryogenic fluid dispensing station with a cryogenic fluid delivery vehicle, comprising:

means for connecting a tank mounted on a fluid delivery vehicle to an offloading port of a supply station;

means for delivering cryogenic fluid from the fluid delivery vehicle to the dispensing station through the off-loading port;

means for sensing a fluid pressure of the cryogenic fluid at the off-loading port; and means for closing a valve on a cryogenic fluid conduit in communication with the off-loading port when the fluid pressure of the cryogenic fluid has dropped below a predetermined level, wherein the fluid from the tank mounted on the delivery vehicle flows to the dispensing station when the dispensing valve is open.

13. An interlock for a system that off-loads cryogenic liquid from a delivery truck and pumps cryogenic liquid to a storage tank, the interlock comprising:

a pneumatic relay for transferring pressurized air to a pneumatic valve of the system, the pneumatic relay including a housing that defines a chamber with a piston having a passage located therein;

a pneumatic line in communication with the pneumatic relay for connecting the pneumatic relay to an air source; and a pressure sensing line in communication with the pneumatic relay for pressurizing the pneumatic relay when a hose from the delivery truck is connected to the system; whereby the interlock prevents cryogenic liquid from exiting the system when the hose from the delivery truck is not connected to the system.

14. The interlock of claim 13, wherein the pressure from the pressure sensing line displaces the piston of the pneumatic relay thereby aligning the passage with the air source and the pneumatic valve to allow pressurized air to travel through the passage to the pneumatic valve.

15. The interlock of claim 13, wherein the passage is arcuate.

16. The interlock of claim 13, wherein the pneumatic relay further comprises a spring for maintaining the piston in a disconnected position when the hose from the delivery truck is not connected to the system.

* * * * *